US007914661B2

(12) United States Patent
Whitmore

(10) Patent No.: US 7,914,661 B2
(45) **Date of Patent: *Mar. 29, 2011**

(54) CATHODIC PROTECTION

(76) Inventor: David Whitmore, Winnipeg (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/854,139

(22) Filed: Sep. 12, 2007

(65) Prior Publication Data

US 2008/0000778 A1 Jan. 3, 2008

Related U.S. Application Data

(63) Continuation of application No. 10/484,036, filed as application No. PCT/CA02/01156 on Jul. 24, 2002, now Pat. No. 7,276,144, which is a continuation-in-part of application No. 09/910,931, filed on Jul. 24, 2001, now Pat. No. 6,572,760, which is a continuation-in-part of application No. PCT/CA00/00101, filed on Feb. 2, 2002, which is a continuation-in-part of application No. 09/245,373, filed on Feb. 5, 1999, now Pat. No. 6,165,346.

(51) Int. Cl.

| | |
|---|---|
| ***C23F 13/16*** | (2006.01) |
| ***C23F 13/08*** | (2006.01) |
| ***C23F 13/10*** | (2006.01) |
| ***C23F 13/12*** | (2006.01) |
| ***C23F 13/14*** | (2006.01) |

(52) U.S. Cl. ..... 205/734; 205/730; 205/731; 205/732; 205/733; 204/196.36; 204/196.37; 204/196.17; 204/196.18; 204/196.19; 204/196.21; 204/196.23; 204/196.24; 204/196.25; 204/196.3

(58) Field of Classification Search ..... 205/730, 205/731, 732, 733, 734; 204/196.17, 196.18, 204/196.19, 196.21, 196.23, 196.24, 196.25, 204/196.3, 196.36, 196.37

See application file for complete search history.

(56) References Cited

U.S. PATENT DOCUMENTS 1,269,926 A 6/1918 Gesell (Continued)

FOREIGN PATENT DOCUMENTS

EP 0 280 427 8/1988

(Continued)

OTHER PUBLICATIONS

Jack Bennett, Chemical Enhancement of Metalized Zinc and one Performance, 1998, 640/1-640/12, NACE International, Houston, Texas (12 pages).

(Continued)

*Primary Examiner* — Bruce F Bell

(74) *Attorney, Agent, or Firm* — Adrian D. Battison; Ade & Company Inc.

(57) ABSTRACT

Cathodic protection of a structure including a steel member at least partly buried in a covering layer, such as steel rebar in a concrete structure, is provided by embedding sacrificial anodes into the concrete layer at spaced positions over the layer and connecting the anodes to the rebar. The anode body is formed, by pressing together finely divided powder, flakes or fibers of a sacrificial anode material such as zinc to define a porous body having pores therein. The sacrificial anode material of the anode member is directly in contact with the covering material by being buried or inserted as a tight fit into a drilled hole so that any expansion forces therefrom would be applied to the concrete with the potential of causing cracking. The pores are arranged however such that corrosion products from corrosion of the anode body are received into the pores sufficiently to prevent expansion of the anode body to an extent which would cause cracking of the covering material.

59 Claims, 4 Drawing Sheets

U.S. PATENT DOCUMENTS

| | | | | |
|---|---|---|---|---|
| 2,193,667 | A | 3/1940 | Barry | |
| 2,565,544 | A | 8/1951 | Brown | |
| 2,743,227 | A | 4/1956 | Gaite et al. | |
| 3,414,496 | A | 12/1968 | Sudbury et al. | |
| 3,488,275 | A | 1/1970 | Lloyd | |
| 4,265,725 | A | 5/1981 | Tatum | |
| 4,435,264 | A | 3/1984 | Lau | |
| 4,506,485 | A | 3/1985 | Apostoios | |
| 4,692,066 | A | 9/1987 | Clear | |
| 4,874,487 | A | 10/1989 | Reed | |
| 5,141,607 | A | 8/1992 | Swiat | |
| 5,174,871 | A | 12/1992 | Russell | |
| 5,183,694 | A | 2/1993 | Webb | |
| 5,254,228 | A | 10/1993 | Westhof | |
| 5,292,411 | A | 3/1994 | Bartholomew et al. | |
| 5,296,120 | A | 3/1994 | Bennett et al. | |
| 5,364,511 | A | 11/1994 | Moreland | |
| 5,366,670 | A | 11/1994 | Giner | |
| 5,431,795 | A | 7/1995 | Moreland et al. | |
| 5,505,826 | A | 4/1996 | Haglin | |
| 5,609,748 | A | 3/1997 | Kotowski et al. | |
| 5,650,060 | A | 7/1997 | Huang | |
| 5,714,045 | A | 2/1998 | Lasa | |
| 5,968,339 | A | 10/1999 | Clear | |
| 5,985,011 | A | 11/1999 | Foltz et al. | |
| 6,022,469 | A * | 2/2000 | Page | 205/734 |
| 6,033,553 | A | 3/2000 | Bennett | |
| 6,165,346 | A | 12/2000 | Whitmore | |
| 6,193,857 | B1 | 2/2001 | Davison | |
| 6,303,017 | B1 | 10/2001 | Page et al. | |
| 6,332,971 | B1 | 12/2001 | Hill | |
| 6,471,851 | B1 * | 10/2002 | Bennett | 205/730 |
| 6,572,760 | B2 * | 6/2003 | Whitmore | 205/734 |
| 7,226,532 | B2 * | 6/2007 | Whitmore | 205/734 |
| 7,276,144 | B2 * | 10/2007 | Whitmore | 205/734 |

FOREIGN PATENT DOCUMENTS

| | | |
|---|---|---|
| EP | 0 479 337 A2 | 4/1992 |
| EP | 0 499 437 A1 | 8/1992 |
| NL | 7608443 | 1/1978 |
| WO | WO 92/01824 | 2/1992 |
| WO | WO 93/12052 | 6/1993 |
| WO | WO 94/29496 | 12/1994 |
| WO | WO 98/16670 | 4/1998 |
| WO | WO 00/46422 | 10/2000 |

OTHER PUBLICATIONS

International Conference on Corrosion and Rehabillitation of Reinforced Concrete Structures, Dec. 7-11, 1998, Orlando, Florida (16 pages).

* cited by examiner

CATHODIC PROTECTION

This application is continuation application of application Ser. No. 10/484,036 filed Jul. 21, 2004 now U.S. Pat. No. 7,276,144 which is a continuation in part application from application Ser. No. 09/910,931 filed 24 Jul. 2001 and now issued as U.S. Pat. No. 6,572,760 which is a continuation in part application from Application PCT/CA00/00101 filed Feb. 2, 2000 and now abandoned which is a continuation in part application from application Ser. No. 09/245,373 filed Feb. 5, 2001 and now issued as U.S. Pat. No. 6,165,346.

This invention relates to a method for cathodic protection which is particularly but not exclusively arranged for use with reinforced concrete and to an anode construction for use with a method of cathodic protection.

BACKGROUND OF THE INVENTION

Cathodic protection of steel elements at least partly embedded in a surrounding layer is well known and one method for this purpose is described in PCT Application CA00/00101 filed 2 Feb. 2000 and published as WO 00/46422 by the present inventor.

In PCT Published Application WO94/29496 of Aston Material Services Limited is provided a method for cathodically protecting reinforcing members in concrete using a sacrificial anode such as zinc or zinc alloy. In this published application and in the commercially available product arising from the application, there is provided a puck-shaped anode body which has a coupling wire attached thereto. In the commercially available product there are in fact two such wires arranged diametrically opposed on the puck and extending outwardly therefrom as a flexible connection wire for attachment to an exposed steel reinforcement member.

The puck is surrounded by an encapsulating material such as mortar which holds an electrolyte that will sustain the activity of the anode. The mortar is compatible with the concrete so that electrolytic action can occur through the mortar into and through the concrete between the anode and the steel reinforcing member.

The main feature of the published application relates to the incorporation into the mortar of a component which will maintain the pH of the electrolyte in the area surrounding the anode at a high level of the order of 12 to 14.

In use of the device, a series of the anodes is provided with the anodes connected at spaced locations to the reinforcing members. The attachment by the coupling wire is a simple wrapping of the wire around the reinforcing bar. The anodes are placed in locations adjacent to the reinforcing bars and re-covered with concrete to the required amount.

Generally this protection system is used for concrete structures which have been in place for some years sufficient for corrosion to start. In general, areas of damage where restoration is required are excavated to expose the reinforcing bars whereupon the protection devices in the form of the mortar-covered pucks are inserted into the concrete as described above and the concrete refilled.

These devices are beginning to achieve some commercial success and are presently being used in restoration processes. However improvements in operation and ergonomics are required to improve success of this product in the field.

U.S. Pat. No. 6,193,857 (Davison) assigned to Foseco discloses an anode body in the form of a puck coated with a mortar in which the puck is attached by ductile wires to the rebar within an excavation in the concrete.

During cathodic protection using a sacrificial anode material, it is well known that the anode must corrode in order to provide the protection thus generating corrosion products. Many potentially suitable anode materials such as magnesium are difficult to use in view of the significant increase in volume which occurs as the material corrodes which thus applies significant forces to the surrounding material generally concrete with the tendency to cause cracking. Even zinc which is the most common material increases in volume and the corrosion products must be accommodated within a mortar material surrounding the anode in order to prevent cracking. As shown in the above Aston application, this mortar can be attached to the anode and is inserted therewith into the concrete as the anode is embedded. Alternatively, the anode can be embedded in a filler material which has characteristics designed to absorb the expansion. It has not been possible however up to date to directly locate or embed the anode body into the concrete so that the surface of the anode material is directly in contact with the conventional concrete, or arranged so that expansion forces from the expansion of the anode during corrosion are applied to the concrete directly or through an incompressible intermediate material, since the concrete material will not accept a significant level of expansion leading to unacceptable cracking.

This significantly increases the cost and complexity of the anode members and reduces the acceptability of the method.

SUMMARY OF THE INVENTION

It is one object of the present invention, therefore to provide an improved method for cathodic protection and an improved anode member for use in cathodic protection in which the difficulties of expansion caused by the corrosion products is reduced or eliminated.

According to a first aspect of the invention there is provided an anode assembly for use in cathodic protection of a steel member in a covering material, the anode assembly comprising:

an anode body separate from the covering material and at least partly formed from a sacrificial anode material of a character which corrodes relative to the steel member to form corrosion products;

the anode assembly being arranged for embedding in the covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive material incorporated during forming of the anode assembly, said additive material comprises a humectant material within at least a portion of the anode assembly which is porous, and said humectant material (i) maintaining moisture in the anode assembly so as to maintain conductivity around the anode material and (ii) keeping an interface of the anode material electrochemically active to ensure that current flow is maintained; and wherein the porous material, including the humectant material, has an alkalinity which alone is insufficient to maintain the cathodic protection.

The covering material may be concrete or may be another material which required steel reinforcement or includes steel buried therein. The covering material may be a single integral layer or may be formed from a parent material with a patch over an area. Where a patch is provided, the covering material in the patch may be identical to or the same as the parent material or it may be of a different character, but together the two materials define the "covering material" as set forth above. Yet further, the covering material may be formed from a parent or existing layer containing the steel and an overlay or covering layer applied onto the existing layer. Again the two layers may be identical or may be different. While the description herein relates primarily to repair of existing concrete, the anode members and the method disclosed herein can also be used for new installation of concrete (or other material of a similar nature) where the anode members can be simply inserted into the concrete as laid, with the absorption of the expansion of the corrosion products simplifying the construction as discussed herein.

In many cases, the anode body is wholly formed from the porous material. However the use of a solid core is also contemplated which is attached to the electrical contact with an outer portion surrounding the core formed of the porous material.

The pores may be empty or void. In the alternative some or all of the pores may contain partly or wholly a material different from the anode material itself which allows the penetration of the corrosion products into the partly filled pores. Thus where the anode materials are formed with an electrical enhancement material as described hereinafter, some of the pores may be voids, some of the pores may be partly filled with the enhancement material and some may be filled by the enhancement material. The corrosion products clearly may be absorbed into the void areas of the empty of partly filled pores. Depending upon the selection of enhancement material which may be soluble, the partly filled pores may also be available to absorb the corrosion products.

In most cases, the outside surface is in direct contact with the concrete but the present invention contemplates and arrangement in which there is an intervening material between the outer surface and the concrete which is either too thin or too incompressible to absorb potential expansion forces.

In one arrangement, this absorption of the expansion of the corrosion products allows the anode body to be provided with a cylindrical outer surface which is arranged to be a tight fit within the wall of a drilled hole so as to be held in place at least partly by engagement of the outer surface with the wall of the hole. Thus the outer surface of the anode body is in direct contact with the inner surface of the hole in the concrete which surprisingly provides the required ion transmission through the interface. Thus the absorption of the expansion into the body itself allows the simple direct insertion of the anode body into the hole without danger of the cracking of the concrete during the life of operation of the cathodic protection.

In this arrangement, the anode body can conveniently include an electrical connector at its end arranged to be held in electrical connection with the steel member by pressure thereon caused by the engagement of the side walls with the hole. Thus the anode can be impacted to drive it into the hole which holds the electrical connection at the forward end permanently in electrical contact with the steel bar. The electrical connection can be a steel rod partially extending into the anode body or can be a multi-strand wire embedded in the anode body with its forward end splayed and impacted onto the steel.

In a preferred method of construction, the anode body is formed at least partly of finely divided materials which are pressed together. The finely divided materials can pressed together with heat, although this is generally not required and may affect the enhancement material if used. The finely divided materials can be at least partly formed of particles of larger dimensions in one or more directions such as shavings, flakes or fibers, rather than powder or granules since this increase in dimension in one or more directions provides an increase in mechanical and electrical connection between the particles while still leaving the required pores. Fibers are of course increased in dimension in one direction while flakes or shavings are increased in two directions. Both types of materials are readily available commercially. Powder is cheaper and therefore may be used to form the bulk of the anode body with some proportion of flakes or fibers.

Other methods of construction of the porous anode are also available and within the scope of this invention such as foaming to generate pores in the anode material or crushing of solid sheet to encapsulate the pores.

Preferably the anode body includes admixed therewith an enhancement material for co-operating with the sacrificial anode material in enhancing the communication of ions between the concrete layer and the anode material, which material is bound into the sacrificial anode material of the solid anode body so as to be carried thereby. Such enhancement materials are disclosed in the above application of the present inventor wherein the enhancement material is carried in the anode body in a manner which causes the presence of the enhancement material to communicate ions at the electrical interface of the anode body to keep the interface electrochemically active to ensure that sufficient current is maintained between the anode body and the steel member at a level greater than would occur in the absence of the enhancement material during the life of the anode body to maintain said cathodic protection.

In one embodiment, the enhancement material can be a humectant by which the presence of the humectant material bound into the anode body acts to absorb sufficient moisture into the anode body to maintain conductivity around the anode body to a level greater than would occur in the absence of the humectant material.

In another embodiment, the enhancement material can be an alkali arranged to increase the pH of the anode body to a level greater than 12 and preferably greater than 14. This embodiment is known per se from PCT Published Application WO94/29496 of Aston Material Services Limited, where the main feature relates to the incorporation into the mortar of a an alkali with a pH of the order of pH 12 to 14 or greater which will maintain a high alkalinity of the electrolyte in the area surrounding the anode.

When the enhancement material is not an alkali, the enhancement material has an alkalinity less than the above stated pH 12, which is alkalinity is alone insufficient to maintain the cathodic protection. The enhancement material thus selected operates to maintain the cathodic protection in a different manner.

When the enhancement material is an humectant, the humectant has an alkalinity less than the above stated pH 12, which is alkalinity is alone insufficient to maintain the cathodic protection. The humectant thus selected operates to maintain the cathodic protection in a different manner.

As a further alternative, enhancement materials can also be used in combination so that the effects of each are used in combination to maintain the cathodic protection.

In all embodiments the enhancement materials maintain current at a higher level than would be maintained in the absence of the enhancement materials.

The enhancement materials can be selected to assist in forming corrosion products which are soluble so that some of the corrosion products may diffuse out of the anode body into the surrounding covering material in a form which does not promote cracking. Also the enhancement material itself may become dissolved over time and diffuse from the pores, thus providing a greater volume of void for receiving the corrosion products. Both of these actions tend to reduce the requirement for the total volume of void.

In place of the embodiment where separate anode members are placed in drilled holes, an alternative can be used for large patch repair wherein the anode member comprises an electrically conductive array preferably formed by an electrical conductor of steel, which array is at least partly covered by or composed of said anode material. Thus the array is located in a hole area excavated during a patching process, one end of the conductor is connected to the rebar and the array and the hole is covered by the patching concrete.

The array may be substantially wholly covered by the anode material leaving at least one portion of the electrical conductor which is available for connection to the steel member or in an alternative, the array is covered by a plurality of separate anode bodies.

BRIEF DESCRIPTION OF THE DRAWINGS

Embodiments of the invention will now be described in conjunction with the accompanying drawings in which.

DETAILED DESCRIPTION

Attention is directed to the disclosure in the above PCT Application by the present inventor which discloses the manufacture and use of anode bodies including anode materials, enhancement materials and methods of installation. The present embodiments disclosed herein include and use many of the constructions, arrangements and materials described therein.

Figure 1:
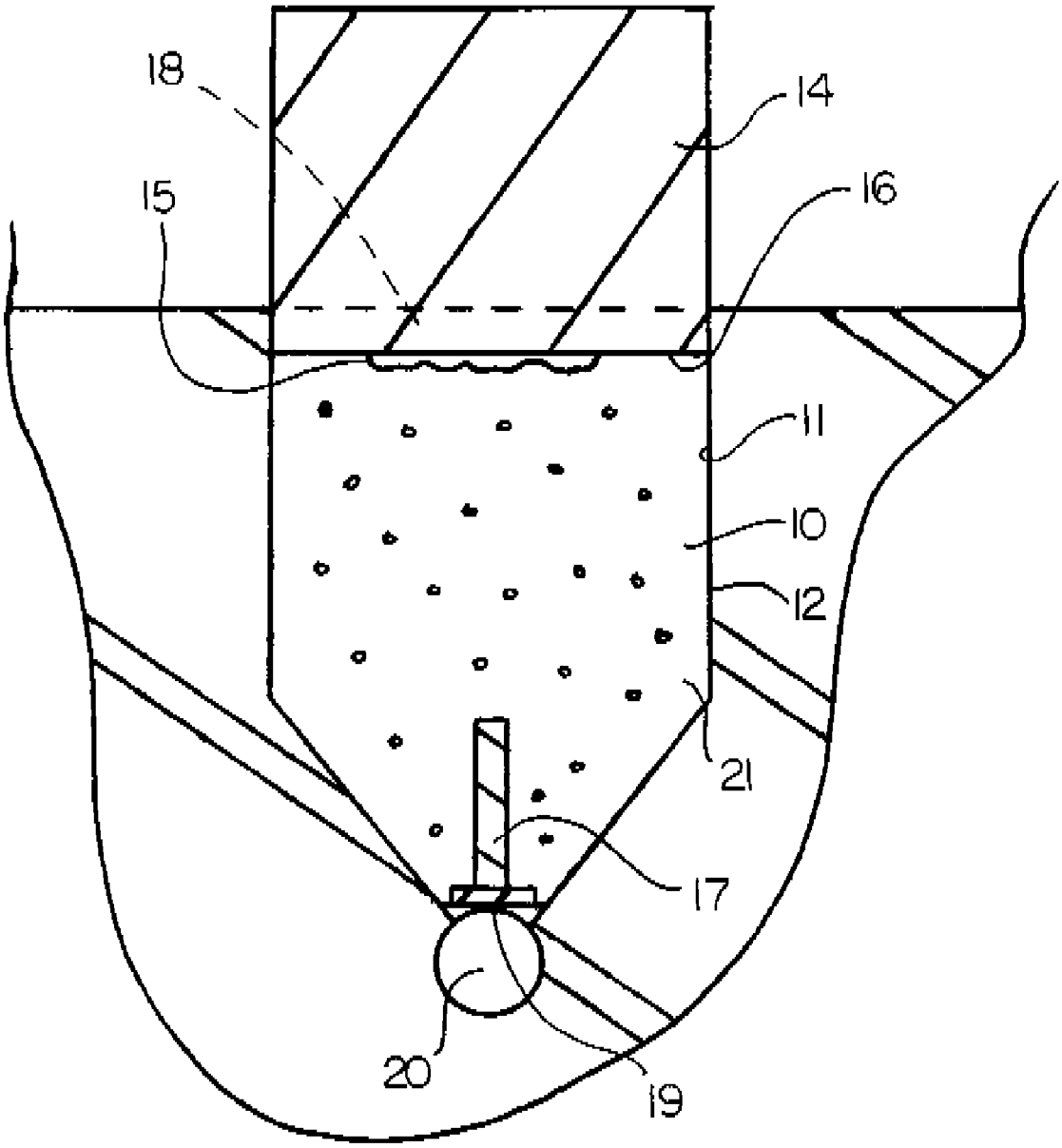
FIG. 1 is a schematic illustration of a method for forming the anode body of FIG. 1.

Turning now to the anode bodies used herein, attention is directed to FIG. 1 which shows one example of a method for manufacturing the anode bodies of the types shown for example in FIGS. 2 to 5.

The enhancement materials and the sacrificial anode material, such as zinc, can be pressed together to form a porous body as shown in FIG. 1.

In FIG. 1 is shown schematically the method for forming the anode body. This comprises a form or mold 30 which defines a hollow interior 31 which is generally cylindrical. At a forward end of the form is provided an end face member 32 which is conical in shape extending inwardly and forwardly from the cylindrical wall 31 to an apex 33 at which is provided a bore 34 extending along the axis of the cylindrical shape to a forward bottom end 35 of the end forming member 32. The conical shape of the forward end is selected to match that of the intended drilled hole, if the anode body is intended for use with a drilled hole, but may also be of other shapes including flat as required for the intended end use.

A steel wire or steel rod 36 is inserted into the hollow interior of the chamber so the forward end extends into the bore 34 down to the end face 35 resting on a support surface 37. Thus the wire or rod extends back from the conical surface into the hollow interior to define a rod which will form a central core of the anode body. The rod or wire is preferably formed of steel so as to provide a suitable electrical connection to the steel of the reinforcement of the concrete.

The zinc particles to form the anode body are mixed with the enhancement material from suitable supplies 38 and 39 within a mixer 40 which is then inserted into a open upper end of the chamber 31. A suitable compression system schematically indicated at 41 is provided so as to apply pressure from a ram 42 onto the mixed materials within the chamber 31. The pressure is thus applied vertically downwardly onto the particulate materials within the chamber applying a compressive action onto the mixed materials sufficient to integrate the structure into the required anode body.

Preferably the anode body is formed simply by pressure on the particulate materials and typically pressures to effect sufficient compaction to maintain an integral structure will be in the range 5,000 psi to 40,000 psi. Heat is therefore preferably not used but can be used to effect a melting of the particles at the points of engagement to enhance structural integrity. However heat can damage many enhancement materials and hence is difficult to use and may require a vacuum to prevent combustion.

The zinc particles can be supplied in the form of powder having a size in the range 325 mesh (that is particles which will pass through a 325 mesh) to 0.25 mm. The particulate materials can be wholly powder but preferably contain a proportion of shavings, fibers or flakes which have increased dimension in one or two directions. Thus fibers may have dimensions of the order of 3 mm to 6 mm in the length direction and a transverse dimension of the order of 0.1 mm. Flakes may have dimensions of the order of 3 mm to 6 mm in the longer directions and a thickness of the order of 0.1 mm. Such shavings, fibers or flakes are commercially available from a number of suppliers. It will be appreciated that the use of particles having increased dimensions in one or two directions increases the mechanical interconnection between the particles thus providing an increased structural strength and an increased structural integrity. The anode body can be formed wholly of such shavings, fibers or flakes. However the cost of this structure of zinc particles is significantly higher than simple powder and hence it is highly desirable to provide an economic balance based upon selecting lower cost powder materials with a suitable proportion of higher cost shavings to provide the required structural integrity and pore dimensions. Typically shavings might form a 20% proportion of the total volume of the zinc particles.

The enhancement material is preferably particulate having a particle size in the range 0.1 mm to 1 mm and is preferably in crystalline form. However other forms of the enhancement material might be used including powder or a pellet form having a significantly greater dimension up to 8 mm. The use of the larger pellets provides improved physical properties in that there is greater particle to particle contact between the zinc particles than can be obtained using smaller particles in powder form. This is achieved because there are reduced number of pellets which are thus located in specific smaller number of locations within the zinc particles thus allowing improved contact between the zinc particles themselves. However it is also a requirement that the enhancement material be spread throughout the zinc so that there also a requirement or a desirability to ensure that the areas of enhancement material are not so isolated from all of the zinc so that the enhancement can not properly occur. Thus a balance must be selected between particle size to ensure that the enhancement operates effectively during the life of the zinc anode while obtaining a suitable structural integrity. Either the powder or pellets of the above dimensions have been found to operate satisfactorily.

The ratio of the zinc particles to the enhancement particles is preferably of the order of 60% zinc particles by volume. However the zinc content may range from 30% to 95% by volume.

Using the above typical pressures, using metal particles of the above dimensions and using the enhancement materials as defined above, the total volume of void within the finished anode body is typically of the order of 5% to 40%. The anode body can be formed without any enhancement materials so that it is formed wholly of the zinc particles defining the pores within the metal body. In such an arrangement it is preferable to have a higher level of void so as to provide sufficient void volume to absorb the corrosion products during the life of the corrosion of the zinc anode body.

In an arrangement where enhancement material is used, it will be appreciated that the compression of the zinc particles forms a series of pores within the zinc structure, some of which are empty so as to form voids, some of which are wholly filled by the enhancement material, and some of which are partly filed with the enhancement material. When the enhancement material is used, some of the voids which are partly or wholly filled with the enhancement material can become available to absorb the corrosion products. Thus in such a case there is the possibility to reduce the total void volume. Thus in other words some of the enhancement material is utilized in the corrosion process and thus makes available its space previously occupied for the receipt of corrosion products. Yet further, some of the enhancement materials may be soluble so that they may gradually defuse out of the anode body leaving their original space available for the corrosion products.

Yet further some enhancement materials, such as lithium hydroxide or calcium chloride, have the advantage that they render the corrosion products more soluble so that the corrosion products themselves may diffuse in solution out of the anode body into the surrounding concrete. Thus it is still required to provide the pores of the present invention so that absorption of corrosion products can occur but the total volume of pores required may be reduced relative to the total volume of corrosion products in view of this diffusion of the corrosion products during the life of the process.

During the life of the process, typical expansion of the volume of the anode body in view of the corrosion products can be achieved in the range 20 to 30 percent, but can be much higher in some cases and particularly when using magnesium or other materials. Thus it is theoretically necessary to absorb into the anode body itself this expansion of 20 to 30 percent. However in view of the above factors it is not necessary in all cases to provide a volume of void space within the anode body equal to the required expansion. The use of the enhancement material within the anode body itself provides the advantages of making available the above additional void space and the possible advantage of rendering more soluble the corrosion products. However it is not essential to provide the enhancement material within the anode body itself since it is possible to provide the enhancement material in a mortar or filler surrounding the anode body. In yet other cases the enhancement material may be omitted since advantage can be obtained simply by using the porous anode body set forth above without any enhancement material.

The humectant material or other enhancement material, if used, is thus selected so that it remains supported by and admixed into the mortar so that it does not significantly migrate out of the anode body during storage or in use.

Figure 2:
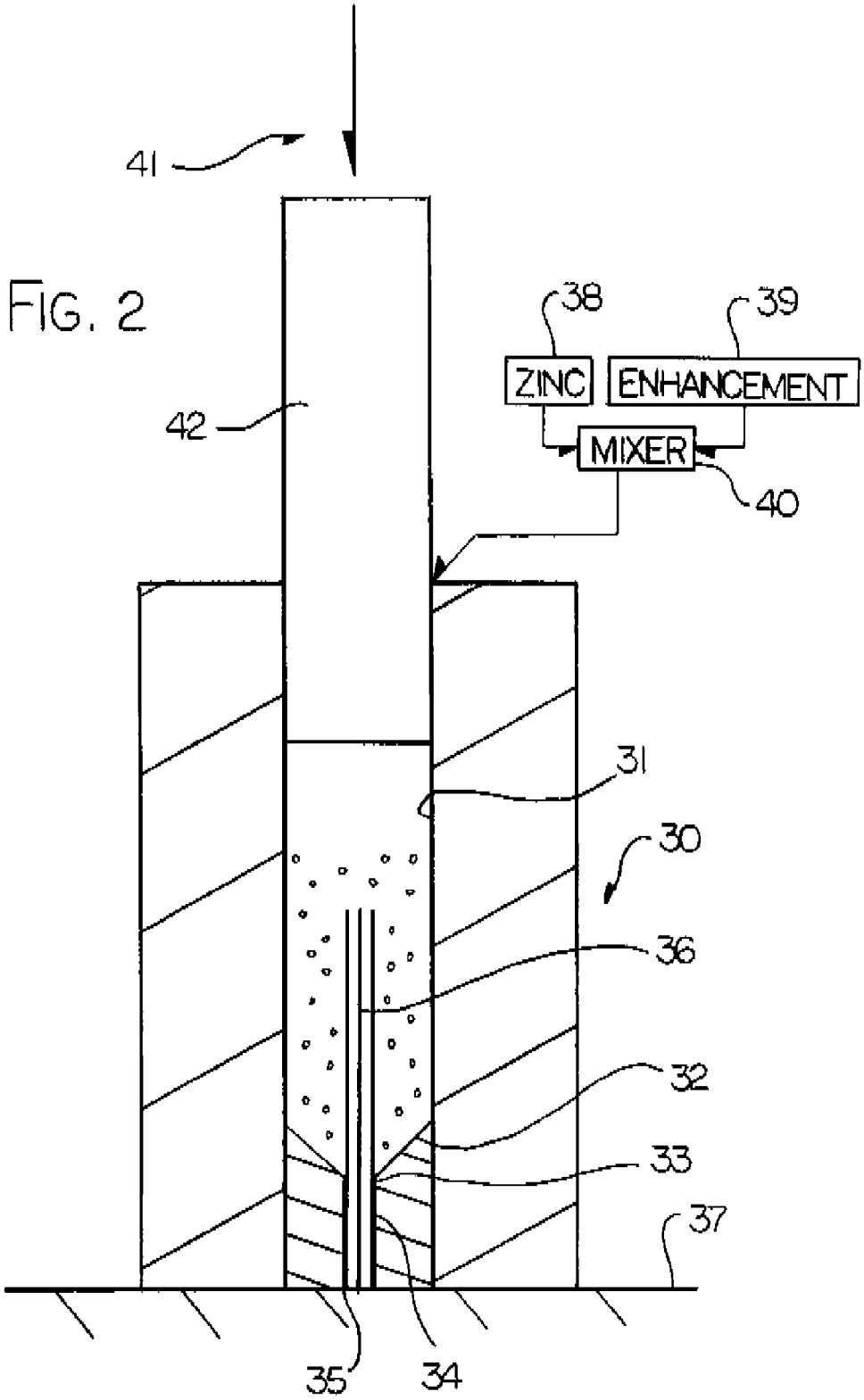
FIG. 2 is a vertical cross sectional view of a first embodiment of anode member including an anode body installed in a drilled hole.

This arrangement has the advantage that the finished product is porous and that corrosion products from corrosion of the anode body during operation are received into the pores of the porous body and thus avoid any expansion of the anode body which could cause cracking of the concrete. This allows the surface of the anode body to lie in direct contact with the concrete either by embedding directly within the concrete or by insertion as a tight fit within a hole as shown in FIG. 2. In all such cases the amount of pores available allows the pressure from the expanded corrosion products to be absorbed within the anode body itself without the necessity for additional materials which act to absorb this pressure or without the modification of the concrete so as to accommodate the pressure.

This is particularly effective when combined with the arrangement of FIG. 2 where the anode body 10 is installed as a tight fit with the cylindrical wall of a drilled hole 11. This formation of the anode body to define pores can be used without the addition into the anode body of the enhancement material. Thus the discrete anode body in porous form, if formed without the enhancement material will be formed wholly of the metallic anode material. The formation and the degree of compression can be selected to generate a porous structure with sufficient pore size and number per unit volume that the whole of the corrosion products is taken up into the pores thus avoiding any expansion of the body caused by the generation of the corrosion products. In addition this may allow the use of other materials such as aluminum or magnesium which are generally considered unsuitable because the corrosion products have a high increase in volume relative to the original metal thus causing severe cracking problems.

Alternatively the anode material can be in wire or foil form and crumpled and compressed to reduce the initially large voids to the required pore sizes to provide the pore volume described above.

Thus in the arrangement shown in FIG. 2, the anode member 10 is shaped as a sliding or tight fit within the drilled hole 11, thus it has a cylindrical outer surface 12 matching closely the diameter of the drilled hole. The anode member is then inserted into the hole either as a tight fit or it is expanded radially into a tight fit within the drilled hole by forces acting to drive the anode member into the hole. This can be done by impact forces or pressure from a tool 14 acting to drive the anode member into the hole. Alternatively the anode member can be expanded for example by an insert driven into the anode member. The anode member may be driven into place by the tool 14 which is shaped to match the top or exposed face but which includes a pattern 15 in relief which forms an embossed pattern in the face 16 of the anode body to confirm to the installer that sufficient force has been applied to drive the member to the required position and to bottom it against the rebar, and if necessary to expand the body to form a tight fit. The engagement of the outside surface of the anode body directly with the drilled surface of the existing concrete surprisingly provides sufficient ionic conductivity in use to ensure the cathodic protection.

In this arrangement, the anode member may include a rigid electrical connector in the form of a steel pin 17 or a flowable metal at its end adjacent the steel member and the rigid electrical connector is driven into connection with the steel member by the same forces. In place of the pin 17 may be provided a conventional multi-strand wire or piece of steel wool which is embedded within a part of the body of the anode leaving a portion of the wire or wool exposed at the forward end. With the wire strands splayed to form a wide contact area, the impact from the anode body presses the wire intimately into engagement with the rebar to provide the necessary electrical connection. This connection is maintained by the fact that the friction fit of the anode body within the hole holds the anode body in fixed position and prevents the electrical contacts from moving apart.

In this way the anode body itself partly or wholly fills the drilled hole, preferably leaving a small volume 18 at the top of the hole to be filled by a cap of filler material simply for aesthetics and to prevent the escape of corrosion products.

In this arrangement, the anode body itself may be formed as a flowable metal allowing the forces to effect the lateral expansion to lock it in place in the hole.

This has the advantage that the product and its installation is very simple, with the anode material and the enhancement materials directly combined into the product itself.

The electrical connection from the anode material to the steel rebar is preferably provided by a material separate from the anode material itself such that its electrical connection is not lost or compromised during the corrosion of the anode. The connecting material is preferably steel. As the anode body in this arrangement is held in place by the frictional forces against the wall of the hole generated by the installation of the anode body, it is only necessary to ensure that the electrical connection is provided by a steel cap 19 or other material located or pinched between the bottom of the anode body and the steel rebar 20. This can be achieved by a multi-filament wire (not shown) embedded in the anode body and splayed at the bottom of the anode body to be pinched by the steel rebar. It can also be provided by a steel cap which engages into or against the rebar. There is no need therefore for a mechanical interconnection between the connector and the rebar although this may also be provided for yet further ensuring electrical connection.

In a further arrangement (not shown), a series of anode members can be installed each in its own hole as a tight fit with an electrical connection in the form of a wire or the like passing from each anode to the next and connected to the rebar at one or more points in the structure. The electrical connection for all the anode members can be effected at one or more points on the array either in a hole dedicated only to connection or at one of the anode members. The electrical connection from each anode to the next thus passes through a cut channel extending from the top of the hole to the top of the next hole so that the top part of the holes and the channels are filled after installation is complete. Thus it is not necessary for the holes to be drilled at the rebar but they can be spaced away from the rebar in some cases allowing deeper holes to be drilled for larger anodes. The rebar need only be exposed at one location by drilling to that rebar specifically for connection or for an anode at that location.

Figure 3:
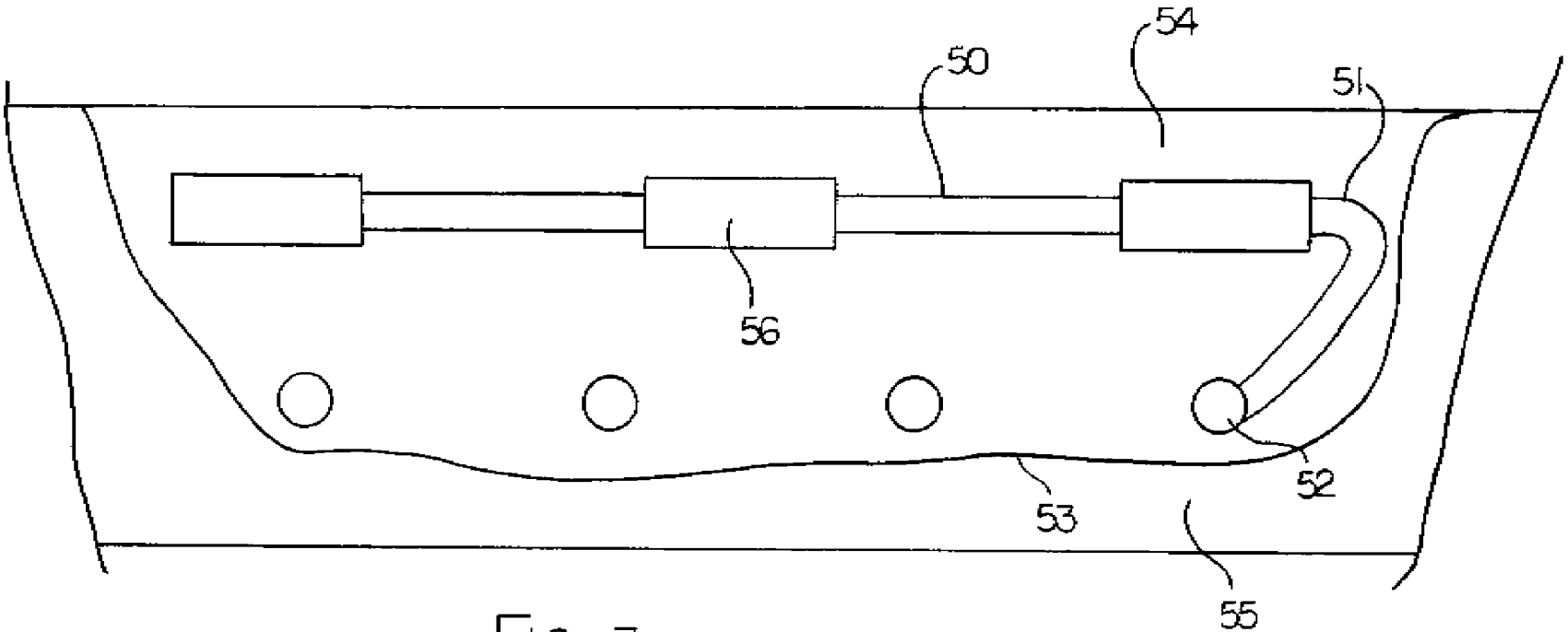
FIG. 3 is cross-sectional view of a second embodiment of anode member including an anode array installed with in an excavated patched area.
Figure 4:
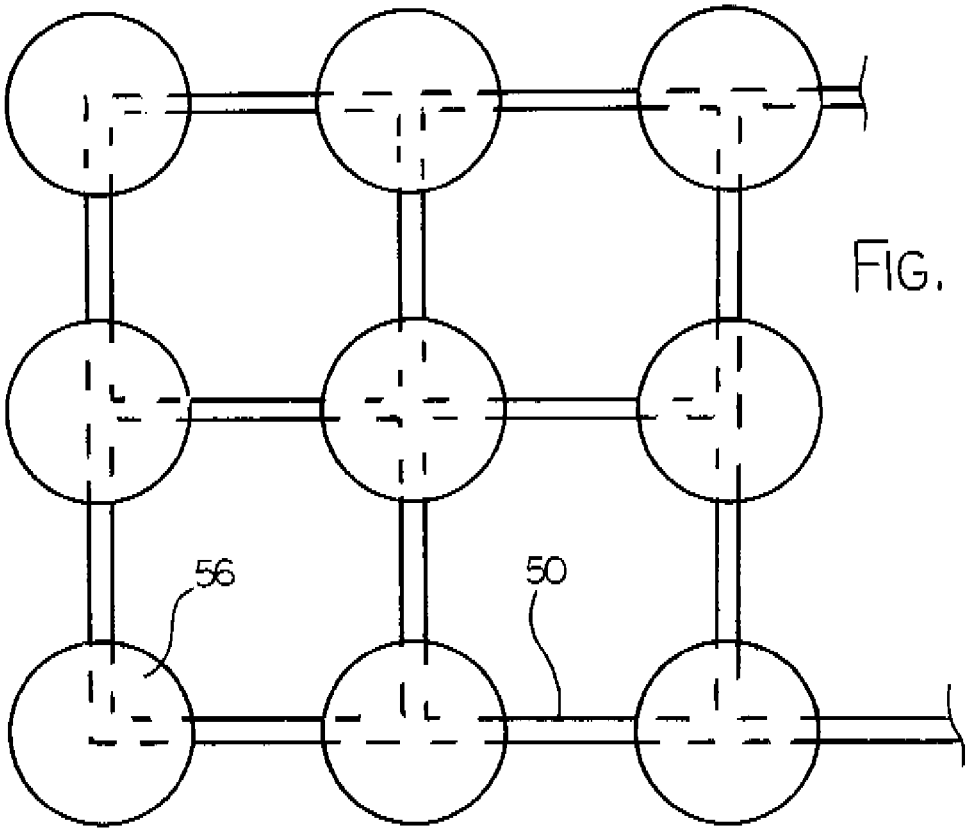
FIG. 4 is a top plan view of the array of FIG. 3.

Turning now to FIGS. 3 and 4 there is shown an alternative arrangement of the anode body for use in a larger patch or for use in an overlay situation where the anode is inserted into a layer of concrete applied as an overlay over an existing or parent layer.

Thus is FIGS. 3 and 4 there is shown an array 50 of an electrical conductor specially formed of steel which is of a dimension sufficient to cover the required area of the patch or the required area of the overlay. One end of the steel wire array is provided as a connector 51 for connection to the steel 52 within the concrete layer.

As shown in FIG. 3 an excavation surface 53 is generated by a suitable excavation technique exposing some or all of the steel members 52. The array 50 is then inserted into the area of the excavation and the array covered by an additional layer 54 of concrete, which or may not be identical to the parent layer 55.

On the array 50 is attached a plurality of separate anode bodies 56 which are pressed in place onto the outside surface of the electrical conductor. Thus the conductor is formed of an integral internal structure within the anode body and provides the necessary electrical connection to the steel 52. The array 50 can be a grid as shown or can be formed from a mesh, ribbon or other structure which is shaped and arranged so as to be suitable for insertion into the area to be protected. A peripheral ribbon may be used around the exterior of a patch so that the electrical connector is in effect simply an elongate strip with anode bodies pressed into place at spaced positions along its length. This one dimensional array can they be inserted in place as required with one end connected to the steel. The two dimensional array shown in FIGS. 3 and 4 can also be used to more accurately locate the anode bodies at spaced positions across the full area to be protected.

Figure 5:
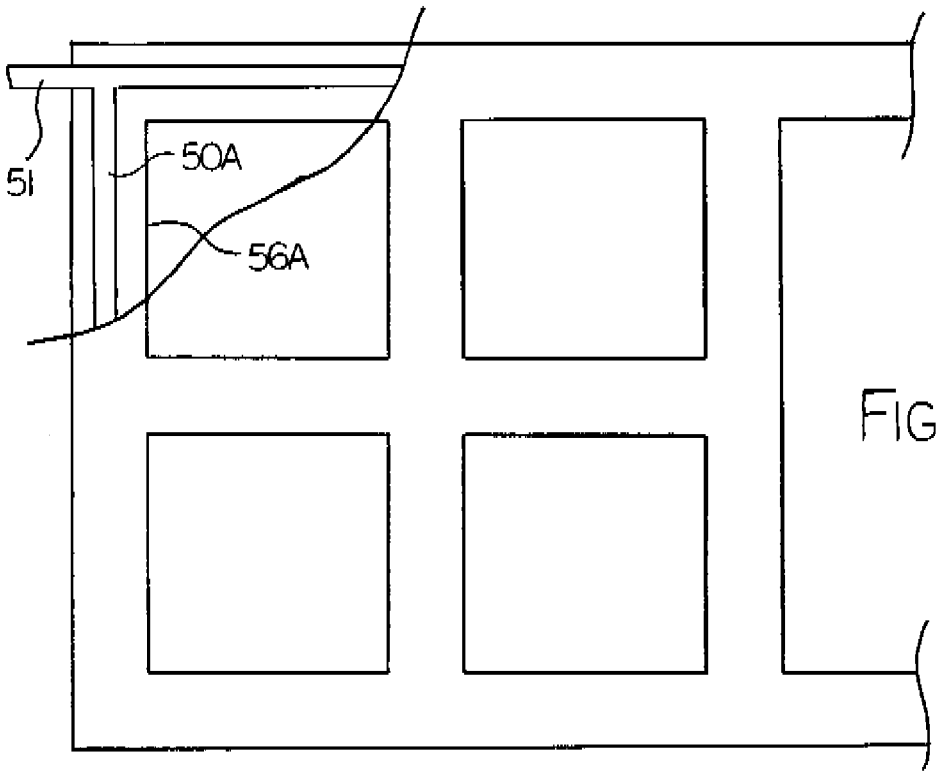
FIG. 5 is a top plan view of an alternative array for use in the patched area of FIG. 3.

In a further alternative arrangement as shown in FIG. 5, the electrical conductive wire 50A is covered substantially over its whole construction by the anode body 56A. Thus in FIG. 4 the anode bodies of a larger dimension for example in the form of discs or pucks. However in FIG. 5, the anode body forms an elongate shape surrounding the whole of the length of the wire which can be of any suitable cross section such as square or round as required. One end 51 is left exposed for connection to the steel 52.

In an alternative arrangement (not shown), the anode array can be covered or buried in a covering layer which is applied onto an existing layer of concrete. Thus the anode may be only partly buried in the original concrete or may be wholly outside the original concrete and thus may be covered by the new concrete applied. In this way, in some cases, no excavation or minimal excavation of the original material may be necessary. The additional concrete can be applied by attaching a suitable form, for example a jacket similar to that shown in U.S. Pat. No. 5,714,045 (Lasa et al) issued Feb. 3, 1998. The form shown in this patent is particularly designed for columns but other arrangements could be designed for other structures. The anode shown in this patent is replaced by the anodes disclosed hereinafter. The forms can be left in place or can be removed.

The array can also be used to provide structural strength. Thus where additional reinforcement is required, for example when the existing steel reinforcement has corroded or where reinforcement is required in an overlay, the array itself can provide the dual function of the anodes for protection of the existing steel and the structural reinforcement of the concrete. This is particularly related to the arrangement where a steel mesh, grid or core is provided and covered partially or wholly by the anode material or anode bodies.

Also the present invention is primarily concerned with concrete structures but some aspects, such as the anode construction, can also be used with other situations where a steel element is buried within a covering layer. The above description is directed to the primary use, but not sole use, with concrete structures.

Suitable humectant materials include $CaCl_2$, $LiNO_3$, $LiCl$, $MgCl_2$, $Ca(SO_4)_2$ and many others well known to one skilled in the art. Such humectant materials are basically in solid or powder form but can be dissolved to form an aqueous solution. Other suitable humectant materials are set out in International Publication WO98/16670 of Bennett and Clear, to which reference may be made.

The cathodic protection device therefore operates in the conventional manner in that electrolytic potential difference between the anode and the steel reinforcing member causes a current to flow therebetween through the electrical connection and causes ions to flow therebetween through the concrete sufficient to prevent or at least reduce corrosion of the steel reinforcing bar while causing corrosion of the anode.

The level of the pH and the presence of the humectant enhances the maintenance of the current so that the current can be maintained for an extended period of time for example in a range 5 to 20 years.

The presence of the humectant material bound into the anode body acts to absorb sufficient moisture to maintain ion transfer around the anode to ensure that sufficient output current is maintained during the life of the anode and to keep the anode/filler interface electrochemically active. The presence also increases the amount of the current.

The anode can be formed of any suitable material which is electro-negative relative to the steel reinforcing members. Zinc is the preferred choice, but other materials such as magnesium, aluminum or alloys thereof can also be used.

This arrangement of providing the agent directly in the anode body allows the construction of an anode body which is of minimum dimensions thus allowing its installation in smaller locations or holes and thus allowing installation in locations where space is limited and thus reducing costs for forming the excavation to allow the installation.

The invention claimed is:

1. A method for cathodic protection:

for a steel member at least partly embedded in a cementitious covering material; the method comprising:

providing a sacrificial anode member in the form of a body separate from the cementitious covering material; the anode member including a sacrificial anode material of a character which corrodes relative to the steel member to form corrosion products; and the anode member including a porous material;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member includes an additive enhancement a material within at least part of said porous material arranged to (i) maintain moisture in the anode member so as to maintain conductivity at an interface of the anode material and (ii) keep the interface of the anode material electrochemically active to ensure that current is maintained; and wherein the enhancement material has a pH which is less than 12.

2. A method according to claim 1 wherein the cementitious covering material in which the anode member is embedded comprises fresh covering material added in connection with installation of the anode member.

3. A method according to claim 1 wherein the enhancement material is at least partly contained within the sacrificial anode material of the anode member.

4. A method according to claim 1 wherein the enhancement material maintains the current at a higher level than would occur in the absence of the enhancement material.

5. A method according to claim 1 wherein the porous material includes a mortar material.

6. A method according to claim 5 wherein at least part of the enhancement material is admixed in the mortar material.

7. A method according to claim 1 wherein the anode assembly includes, in said at least a portion thereof which is porous, an alkaline material having a pH greater than 12.

8. A method according to claim 1 wherein the anode assembly includes a porous filler material.

9. A method according to claim 8 wherein the filler material includes at least part of the enhancement material.

10. A method for cathodic protection:

for a steel member at least partly embedded in a cementitious covering material; the method comprising:

providing an anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher Level than would occur in the absence of the enhancement material;

wherein said enhancement material comprises a halide salt.

11. A method for cathodic protection:

for a steel member at least partly embedded in a cementitious covering material; the method comprising:

providing an anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein the enhancement material comprises chloride.

12. The method according to claim 11 wherein the enhancement material comprises calcium chloride.

13. A method for cathodic protection:

for a steel member at least partly embedded in a cementitious covering material; the method comprising:

providing a sacrificial anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein said enhancement material comprises sulfate.

14. The method according to claim 13 wherein the enhancement material comprises calcium sulfate.

15. A method for cathodic protection:

for a steel member at least partly embedded in a cementitious covering material; the method comprising:

providing a sacrificial anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein said enhancement material comprises nitrate.

16. A method for cathodic protection:

for a steel member at least partly embedded in a cementitious covering material; the method comprising:

providing a sacrificial anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein the enhancement material has a pH which is less than 12.

wherein said enhancement material comprises a calcium salt.

17. A method for cathodic protection:

for a steel member at least partly embedded in a cementitious covering material; the method comprising:

providing a sacrificial anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein the enhancement material has a pH which is less than 12.

wherein said enhancement material comprises a lithium salt.

18. A method for cathodic protection:

for a steel member at least partly embedded in a cementitious covering material; the method comprising:

providing a sacrificial anode member including a sacrificial anode material of a character which corrodes relative to the steel member to form corrosion products;

embedding the anode member in the cementitious covering material;

and electrically connecting the anode member to the steel member so that an electrical galvanic potential therebetween causes corrosion of the sacrificial anode material and tending to inhibit corrosion of the steel member;

wherein the anode member is in contact with a porous material having an enhancement material therein;

wherein the enhancement material is of a character such that in use it acts to maintain galvanic current at a higher level than would occur in the absence of the enhancement material;

wherein the enhancement material has a pH which is less than 12.

wherein said enhancement material comprises a magnesium salt.

19. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous of a character such that in use it acts to (i) maintain moisture in the anode assembly so as to maintain conductivity at an interface of the anode material and (ii) keep the interface of the anode material electrochemically active to ensure that current is maintained; and wherein the enhancement material has a pH which is less than 12.

20. The anode assembly according to claim 1 wherein the enhancement material is at least partly contained within the sacrificial anode material of the anode member.

21. The anode assembly according to claim 1 wherein the enhancement material is of a character such that in use it acts to maintain the current at a higher level than would occur in the absence of the enhancement material.

22. The anode assembly according to claim 1 wherein the porous material includes a mortar material.

23. The anode assembly according to claim 22 wherein at least part of the enhancement material is admixed in the mortar material.

24. The anode assembly according to claim 1 wherein the electrical connecting member comprises a different material from the sacrificial anode material.

25. The anode assembly according to claim 24 wherein the electrical connecting member comprises steel.

26. The anode assembly according to claim 1 wherein the anode assembly includes an alkaline material having a pH greater than 12.

27. The anode assembly according to claim 1 wherein the anode member is free of paste or gel material .

28. The anode assembly according to claim 1 wherein the electrical connecting member is affixed to the sacrificial anode material.

29. The anode assembly according to claim 1 wherein the anode assembly includes a porous filler material.

30. The anode assembly according to claim 29 wherein the filler material includes at least part of the enhancement material.

31. The anode assembly according to claim 1 wherein the enhancement material comprises a halide salt.

32. The anode assembly according to claim 1 wherein the enhancement material comprises chloride.

33. The anode assembly according to claim 1 wherein the enhancement material comprises calcium chloride.

34. The anode assembly according to claim 1 wherein the enhancement material comprises magnesium chloride.

35. The anode assembly according to claim 1 wherein the enhancement material comprises nitrate.

36. The anode assembly according to claim 1 wherein the enhancement material comprises sulfate.

37. The anode assembly according to claim 1 wherein the enhancement material comprises calcium sulfate.

38. The anode assembly according to claim 1 wherein the enhancement material comprises a lithium salt.

39. The anode assembly according to claim 1 wherein the enhancement material comprises a calcium salt.

40. The anode assembly according to claim 1 wherein the enhancement material comprises a magnesium salt.

41. An anode assembly for use in cathodic protection of a steel member in a cementitious covering material, the anode assembly being arranged for embedding in cementitious covering material;

the anode assembly comprising:

a sacrificial anode material which corrodes relative to the steel member to form corrosion products;

a porous material at least partly surrounding the sacrificial anode material;

an electrical connecting member for electrical connection of the sacrificial anode material to the steel member;

wherein the electrical connecting member comprises a different material from the sacrificial anode material;

wherein the electrical connecting member comprises steel;

wherein at least part of the porous material contains an additive enhancement material arranged to (i) maintain moisture in the anode member so as to maintain conductivity at an interface of the anode material and (ii) keep the interface of the anode material electrochemically active to ensure that current is maintained; and wherein the enhancement material has a pH which is less than 12.

wherein at least part of the enhancement material is admixed with the porous material.

42. The anode assembly according to claim 41 wherein the anode assembly includes an alkaline material having a pH greater than 12.

43. The anode assembly according to claim 41 wherein the enhancement material is of a character such that in use it acts to maintain the current at a higher level than would occur in the absence of the enhancement material.

44. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein said enhancement material comprises a halide salt.

45. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein the enhancement material comprises chloride.

46. The anode assembly according to claim 45 wherein the enhancement material comprises magnesium chloride.

47. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein said enhancement material comprises sulfate.

48. The anode assembly according to claim 47 wherein the enhancement material comprises calcium sulfate.

49. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein said enhancement material comprises nitrate.

50. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein the enhancement material has a pH which is less than 12.

wherein said enhancement material comprises a calcium salt.

51. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein the enhancement material has a pH which is less than 12.

wherein said enhancement material comprises a lithium salt.

52. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein the enhancement material has a pH which is less than 12.

wherein said enhancement material comprises a magnesium salt.

53. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material a material which comprises calcium chloride

54. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material a material which comprises magnesium chloride.

55. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material a material which comprises calcium sulphate.

56. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material a material which comprises lithium nitrate.

57. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material calcium nitrate or calcium nitrite.

58. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes within the porous material lithium chloride.

59. An anode assembly for use in cathodic protection of a steel member in a cementitious covering material, the anode assembly comprising:

an anode body separate from the cementitious covering material and at least partly formed from a sacrificial anode material of a character which corrodes relative to the steel member to form corrosion products;

the anode assembly being arranged for embedding in the cementitious covering material; and the anode assembly including an electrical connecting member for electrical connection to the steel member so that, in use, an electrical galvanic potential therebetween causes corrosion of the sacrificial anode material and tending to inhibit corrosion of the steel member;

wherein at least a portion of the anode assembly comprises porous material;

wherein the anode assembly includes an additive enhancement material within at least a portion of the anode assembly which is porous;

wherein the enhancement material is of a character such that in use it acts to maintain galvanic current at a higher level than would occur in the absence of the enhancement material;

wherein the enhancement material has a pH which is less than 12.

* * * * *